United States Patent [19]

Butts et al.

[11] 3,945,168

[45] Mar. 23, 1976

[54] REUSABLE SPANNER BAR

[75] Inventors: Ernest O. Butts; John S. Hall, both of Ottawa, Canada

[73] Assignee: Hambro Structural Systems Limited, Ottawa, Canada

[22] Filed: Apr. 15, 1974

[21] Appl. No.: 461,221

Related U.S. Application Data

[60] Continuation of Ser. No. 274,414, July 24, 1972, abandoned, which is a division of Ser. No. 220,627, Jan. 25, 1972, Pat. No. 3,845,594, which is a continuation-in-part of Ser. Nos. 872,017, Aug. 29, 1969, abandoned, and Ser. No. 145,758, May 21, 1971, Pat. No. 3,819,143.

[30] Foreign Application Priority Data

| | | |
|---|---|---|
| Nov. 4, 1968 | Canada | 34293 |
| Mar. 16, 1971 | Canada | 107895 |
| May 28, 1970 | Canada | 84014 |

[52] U.S. Cl. ..... 52/720; 249/23; 52/319

[51] Int. Cl.[2] ..... E04B 1/20; E04C 3/30

[58] Field of Search ..... 249/23, 26, 18, 205, 210, 249/211; 52/319, 321, 720

[56] References Cited

UNITED STATES PATENTS

| | | | |
|---|---|---|---|
| 827,268 | 7/1906 | Stieper | 249/211 |
| 1,924,096 | 8/1933 | Adams | 211/46 |
| 1,974,730 | 9/1934 | Zollinger | 52/321 |
| 2,169,253 | 8/1939 | Kotrbaty | 52/693 |
| 2,202,096 | 5/1940 | Dell et al. | 249/210 |
| 2,508,635 | 5/1950 | Badt | 249/23 |
| 2,511,584 | 6/1950 | Hill | 249/26 |

FOREIGN PATENTS OR APPLICATIONS

| | | | |
|---|---|---|---|
| 428,208 | 5/1935 | United Kingdom | 249/23 |
| Ad.73,318 | 6/1960 | France | 52/695 |
| 553,203 | 12/1956 | Italy | 249/24 |
| 54,813 | 3/1912 | Austria | 211/113 |

*Primary Examiner*—James L. Ridgill, Jr.
*Attorney, Agent, or Firm*—Cushman, Darby & Cushman

[57] ABSTRACT

A steel joist formwork and a composite steel and concrete floor structure provided with a top chord, a bottom chord and a web joining the top and bottom chords with the top chord being serpentine shaped like an S or Z and including top and bottom, generally horizontal portions and an intermediate portion integrally connecting opposite edges of the top and bottom portions with the top and intermediate portions substantially being adapted to be embedded in the concrete floor to cause the floor and steel joists to act structurally as a composite beam. Either the web or a leg depends vertically from the free end of the bottom portion of the top chord, and the web joining the top and bottom chords is substantially solid or is, an open web formed of a zigzag bar member. There is also disclosed a building system and erecting method utilizing steel joists spaced apart by spanner bars which also support rigid panels which act as formwork for the pouring of concrete. The spanner bars and the joists are so arranged to cooperate that the spanner bars may be removed together with the rigid panels after the concrete has been poured, and the spanner bars, the rigid panels and if desired the steel joists may be reused for formwork for additional poured concrete construction. Alternatively the joists may be left in place either with the top chords embedded in the poured concrete to provide a composite action, or merely supporting the concrete slab in the conventional fashion. A novel cold rolled sheet steel joist may be advantageously used to form a particularly economical composite system. This steel joist is shaped in an I-beam configuration with an upper top chord bent to have the appearance of the letter Z in cross-section for bonding with the concrete floor.

11 Claims, 28 Drawing Figures

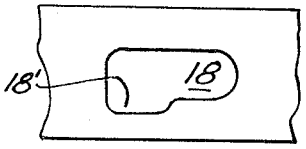
Fig. 15
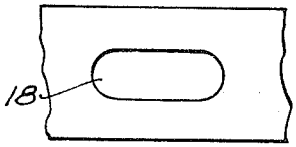
Fig. 17
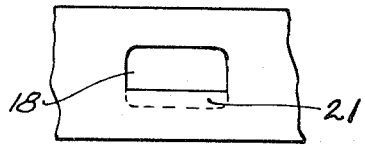
Fig. 19
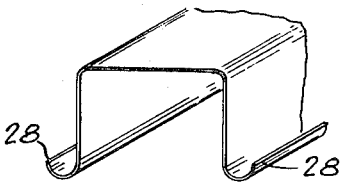
Fig. 20
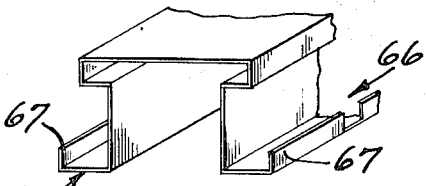
Fig. 21
Fig. 16
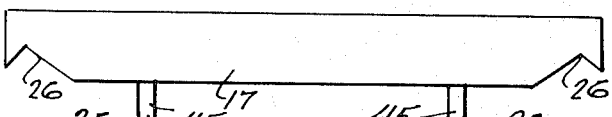
Fig. 18
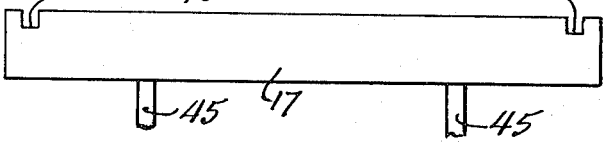
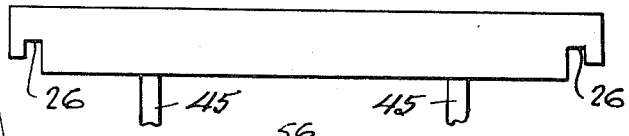
Fig. 22
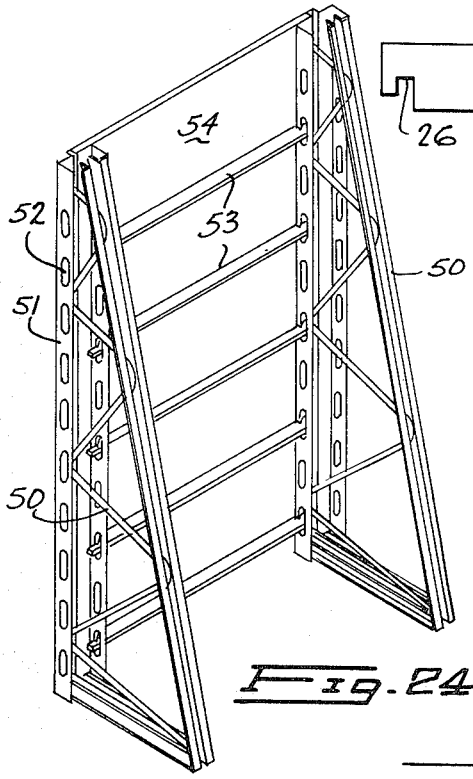
Fig. 24
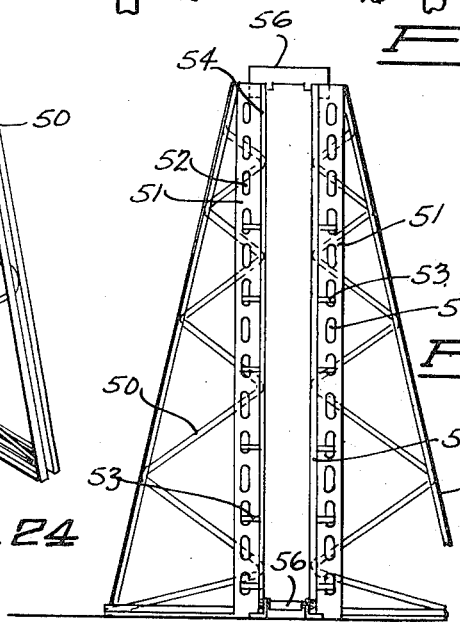
Fig. 23

REUSABLE SPANNER BAR

This is a continuation of application Ser. No. 274,414, filed July 24, 1972, which was abandoned upon the filing hereof and which was a divisional of Ser. No. 220,627, filed Jan. 25, 1972, now U.S. Pat. No. 3,845,594, which in turn was a continuation-in-part of both Serial No. 872,017 filed Aug. 29, 1969 (now abandoned) and Ser. No. 145,758, filed May 21, 1971, now Pat. No. 3,819,143.

The present invention relates to a composite floor system and parts and formwork therefor and erecting method for use in the construction of buildings such as large open span buildings. The present invention is particularly concerned with composite floor systems and a novel form of open web steel joist for use in such a floor system.

In accordance with the present invention, one form of steel joist comprises a top chord, a bottom chord and a zig-zag bar web having its apices welded to the top and bottom chords. The top chord includes a first flange extending parallel to the plane of the web, a second flange connected to the first flange above the web, a third flange obliquely connected to the second flange and a fourth flange connected to the third flange and substantially parallel to the second flange, the second, third and fourth flanges being intended to be partly or wholly embedded in a concrete slab poured on formwork supported by a plurality of such open web steel joists. For the purpose of supporting such formwork, openings are provided in the first flange of the steel joist in which spanner bars may be inserted to support the formwork between the open web joists and to stabilize the joists prior to the pouring of the concrete.

In accordance with a preferred form of the invention, the concrete slab poured on the formwork supported from the bar joists is reinforced with a reinforcing mesh which is draped over the top flanges of the open web steel joists and hangs in a catenary-like shape between the open web joists to provide the most effective shape for shear reinforcement.

The composite floor system utilizing the applicant's novel open web joists is more economical than conventional open web joists systems and permits a variety of forming materials. The mesh embedded in the concrete forms the correct catenary for maximum shear reinforcement of the concrete slab. Plywood forms may be used between the open web joists giving a degree of lateral stability before the concrete is poured and the plywood forms may be reused in subsequent concrete pouring operations.

A particularly significant aspect of the invention is that the spacing between open web joists may be greatly increased over the spacings presently utilized, since the spanner bars positioned between the open web joists and the joists themselves carry the construction loads and the completed composite floor system has adequate strength to carry all design loads once the construction has been completed. It will be appreciated that several inherent advantages of composite contruction are obtained; for example, a whole floor or roof assembly when poured forms a single unit which provides increased strength and stability to the structure.

It is also within the scope of the present invention to form large span floors using the open web joists of of the invention, which may be propped during construction and which when the composite system has achieved its ultimate strength are capable of supporting the design loads across the full span without propping.

The present application also relates to building systems and in particular a building system in which a combination of open web joists, spanner bars and rigid panels are utilized to support a poured concrete floor. In accordance with one form of the invention the spanner bars and rigid panels may be removed after the concrete has set and reutilized. In accordance with a further preferred form of the invention the open web steel joist may also be removed after the concrete has set and reused.

The present application also relates to a composite floor system for use in the design and construction of buildings such as large open span buildings in which a cold rolled sheet steel joist is formed in the shape of an I-beam with an upper chord bent to have the appearance of the letter Z in cross-section.

An object of the invention is to provide an economical and strong composite floor system by the use of cold rolled sheet steel members.

A further object of the invention is to provide a novel spanner or roll bar for use with novel formwork pursuant to the present invention.

A further object of the invention is to provide a floor system which can be adapted to permit efficient and economical erection and disassembly of a multiple use formwork material to receive the concrete slab of this composite floor system. This is accomplished by the use of openings which are cut at regular intervals along the horizontal length of the vertical flange of the cold rolled sheet steel joists into which the ends of the spanner bars which are shaped so that they may, by use of a hammer or similar object, be wedged into this opening. Due to the shape of the openings, the removal of the spanner bars is accomplished by moving the spanner bars in the opposite direction as when they were wedged-in during erection. This latter procedure permits safe and easy removal of firstly the spanner bars and secondly the formwork material. Spanner bars and formwork material can then be reused for the subsequent construction of additional composite floor systems following the teachings of the present invention.

In accordance with the present invention there is provided a building system wherein metal joists are supported in parallel spaced relation, and means are provided for removably supporting rigid panels mounted between and filling the space between adjacent joists, said means comprising at least two bars extending between adjacent joists with the ends of the bars being removably held to the joists.

In the accompanying drawings which illustrate various embodiments of the present invention:

FIG. 1 is a perspective view from below of a composite floor system utilizing the applicant's novel open web joists, FIG. 2 is a perspective view from above illustrating some details of the FIG. 1 construction of open web joists in accordance with the invention, FIG. 3 is a perspective detail illustrating the notches formed in the first flange of the applicant's novel open web joists, FIG. 4 is an elevational end view of an open web joist of the present invention, FIGS. 5 and 6 are elevational views showing portions of floor systems utilizing the open web joists of the present invention, FIG. 7 is a perspective view of an alternative S form of top chord for use with the present invention, FIG. 8 is an end view of a modification of the FIG. 7 form of top chord for joists in accordance with this invention, FIG. 9, is a side view of a portion of any of the top chords of this invention with a modified vertical flange, FIG. 10 is a vertical section through a building system pursuant to the present invention;

FIG. 15 illustrates a less preferred form of elongated slot provided for receiving the end of a spanner bar;

FIG. 16 illustrates a spanner bar adapted for utilization with the elongated slot of FIG. 15;

FIG. 17 illustrates the preferred form of elongated slot;

FIG. 18 illustrates another form of spanner bar;

FIG. 19 illustrates an alternative form of elongated slot intended for utilization with a spanner bar as illustrated in FIG. 18;

FIGS. 20 and 21 illustrate alternative forms of top chord for the open web steel joist for utilization with the roll bar illustrated in FIG. 22;

FIG. 22 illustrates a roll bar adapted for utilization with the top chords of FIGS. 20 and 21;

FIG. 23 is a vertical section through a wall form constructed pursuant to the present invention;

FIG. 24 is a perspective view of the back of a wall form pursuant to the present invention;

Figure 1:
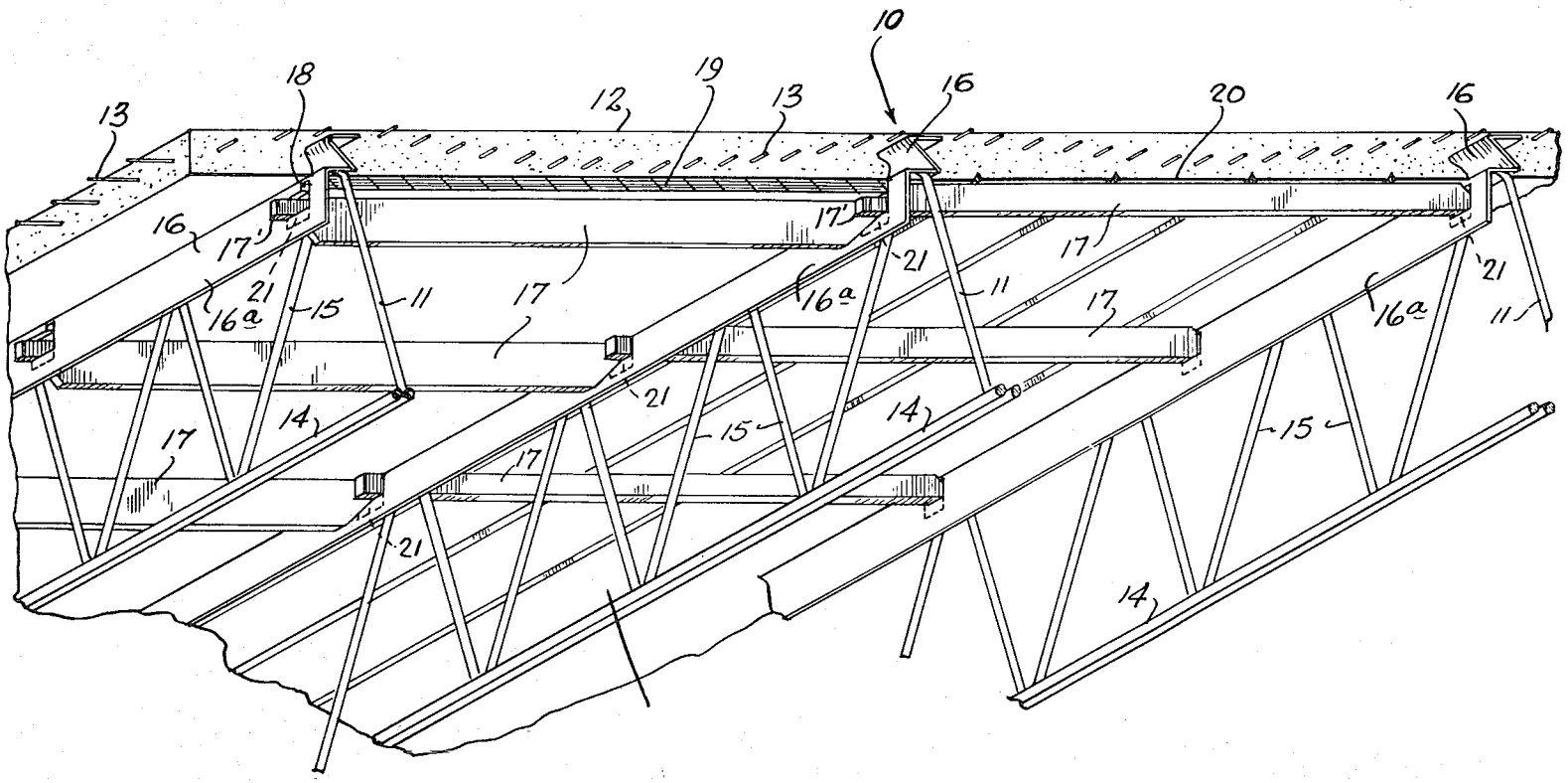

In FIG. 1 there is shown in perspective a composite floor system constructed in accordance with the present invention. A composite floor system is indicated generally at 10 including a plurality of open web or bar joists 11 and a poured concrete slab 12 containing a reinforcing mesh 13. As illustrated in FIG. 1, each of the open web joists 11 includes a bottom chord 14, a zig-zag or serpentine configured bar web 15 and a novel shaped top chord 16 which is described in greater detail below.

Positioned between the bar joists 11 are steel spanner bars 17, the ends 17′ which (see also FIGS. 2, 5, 6 and 28) are offset from either the top or bottom surfaces of the bars and extend through openings 18 formed in the top chord 16 of the open web joists. For ease in inserting the spanner bar ends, openings 18 have an upwardly directed leg 18′ (FIG. 2) for initially receiving the ends 17′ which are then moved or driven and jammed into the shorter horizontal legs of the openings to lateral provide stability, rigidity, proper joist spacing and concrete pouring form support. In the left side of FIG. 1, bars 17 are illustrated in a position supporting a reusable plywood form 19, and in the right side of FIG. 1, bars 17 are illustrated supporting a steel pan 20 of known type.

Figures 2, 3, 4:
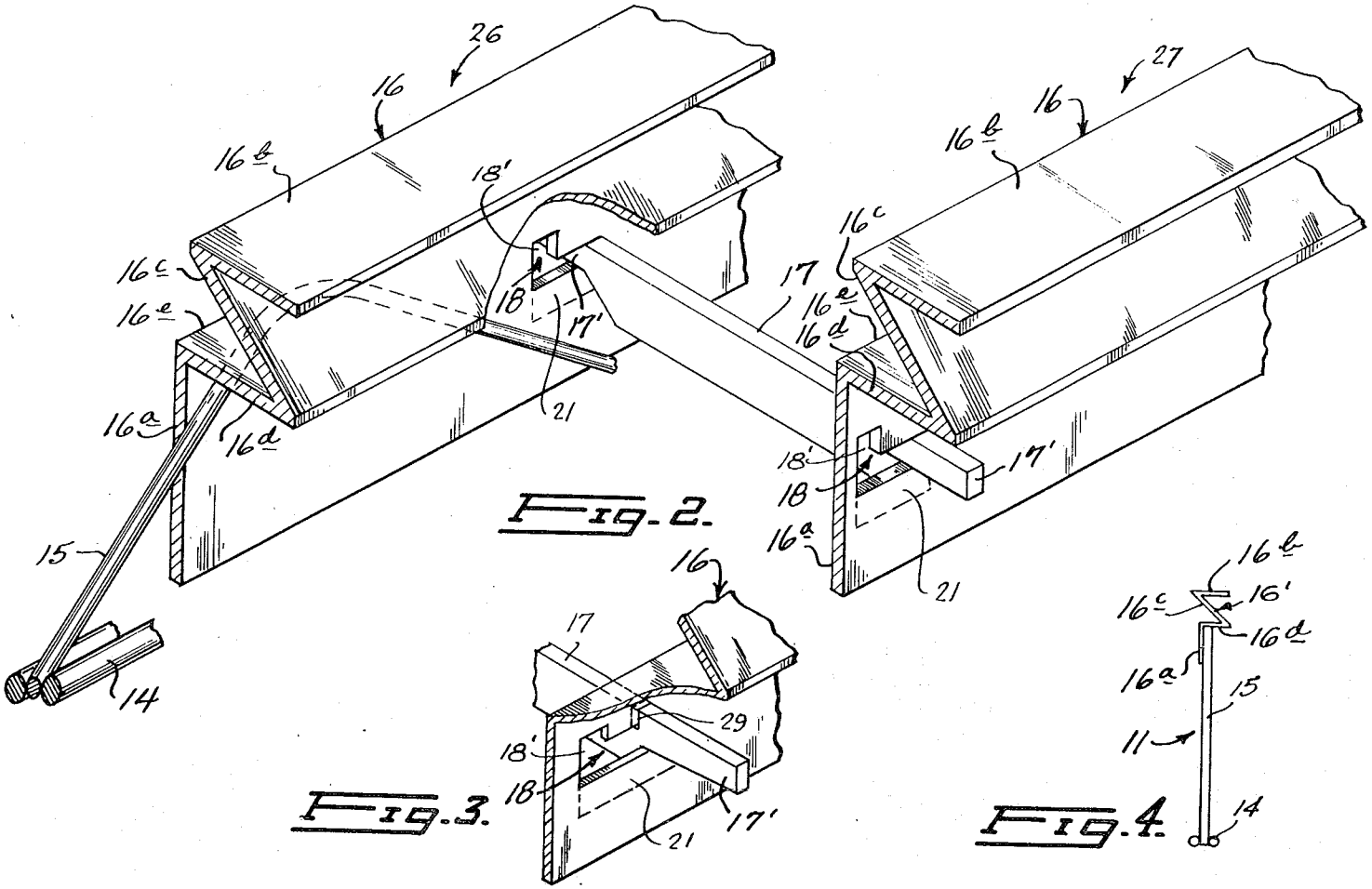

It will be noted in FIGS. 1 and 2 that knock out portions 21 are shown in the depending legs or vertical flanges 16a of top chords 16 in the open web joists 11 beneath the ends of the spanner bars 17. These pieces 21 are so formed (prescored or the like) during manufacture of the open web or bar joists 11 that they form knock out panels which can be removed after the concrete has been poured in the composite floor system and the spanner bars 17 and the formwork 19 or 20 removed and reused for the subsequent pouring of additional composite floors following the teachings of the present invention. Alternative and more preferred forms of spanner bar 17 and openings 18 are illustrated in FIGS. 15 – 19 and 28. It will be appreciated that the size and shape of the opening 18 in which the ends of the spanner bar 17 are fitted may depend upon the particular form of spanner bar used and similarly the size and shape of the knockout panel 21 will also vary depending upon the particular type of spanner bar used. In FIG. 1, spanner bars 17 on the left side of the drawing are shown a substantial portion of the bar projecting below the apertures or slots 18 (see also FIG. 5), while in the right side of FIG. 1 (and in FIG. 6) the substantial portion of the bar projects above apertures 18. That is, in accordance with a further feature of the invention, such a shape of spanner bar permits the use of either a thicker plywood type panel or form 19 or a thinner sheet metal pan type panel 20 merely by reversing the position of the bar 17 during insertion. For use with the plywood panels, the offset at the ends of 17′ of the spanner bars is from the lower surface thereof, but for the sheet metal panels 20 the offset of the spanner bar ends 17 is relative to the upper surface of the bars. It is contemplated that the spanner bars 17 normally would be removed from the composite structure and the formwork such as 19 in FIG. 1 would be taken away and reused. However, it will be appreciated that a specific application in accordance with the invention might include retaining the spanner bars as part of the permanent structure although normally these bars are removed together with the concrete supporting formwork once the concrete has set.

In FIG. 2, there is illustrated in perspective, a pair of open web bar joists 26 and 27 (each the same as joists 11 in FIG. 1) and a spanner bar 17. As previously mentioned, the spanner bar openings 18 are disposed in the depending leg or vertical flange 16*a* of the top chord 16 together with knock out panel 21 which may be removed after the concrete of the composite floor is poured to release the spanner bar 17. In this embodiment, the novel serpentine shaped top chord 16 has a transverse cross-section in the form of the letter Z, i.e., of a zig-zag configuration, and includes three integral portions or flanges 16*b*, 16*c*, and 16*d* besides leg 16*a*. Top and bottom portions 16*b* and 16*d* are superposed with intermediate portion 16*c* angling or being disposed obliquely between opposite ends of those top and bottom portions. This shape provides for greater transfer of load from the slab to the joist and greatly increased shearing resistence between the top chord and the concrete floor. Of considerable importance as later described is the fact that leg 16*a* depends from the free end or edge 16*e* of the bottom portion.

Figure 28:
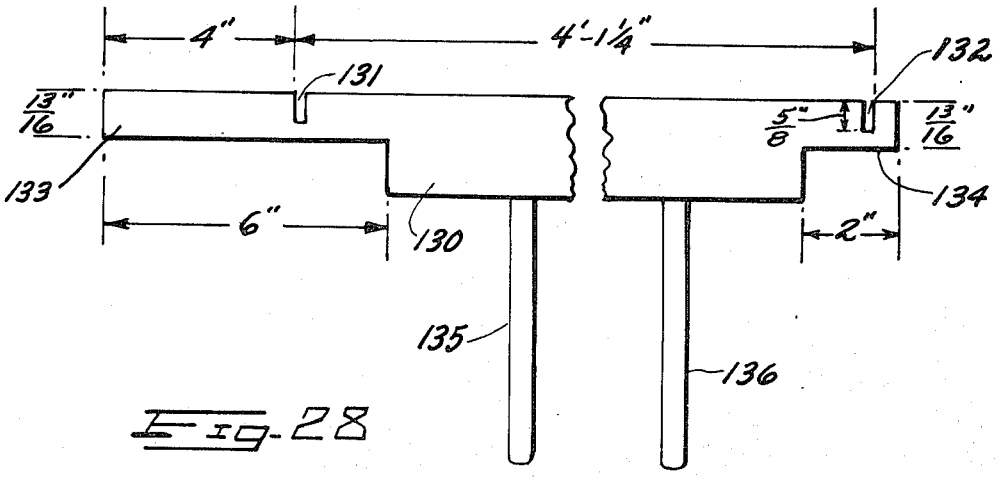

In FIG. 3 an alternate form of spanner bar 17 is illustrated as including a notch 29 which co-operates with the sides of the opening 18 to increase the structural rigidity of the open web joists and spanner bars during construction as more fully discussed in relation to FIG. 28. This increased rigidity is sufficient to eliminate the requirement for bottom bridging during erection and prior to setting of the concrete. The ends 17' of the bars may alternatively be longitudinally wedged shaped if desired.

FIG. 4 is a vertical transverse section or end view through a bar joist constructed in accordance with the present invention clearly illustrating the cross-section of the novel top chord 16 of the present invention. The bottom chord 14 which, in this particular joist (and in FIG. 1) is shown as formed of a pair of rods, is welded to the bottom apices of zig-zag web 15 which in turn is welded at its upper apices to the top chord 16. As shown, the lower horizontal flange 16*d* bottoms on the top of web 15, which is secured against the depending leg or vertical flange 16*a* for greater stability.

Figure 5:
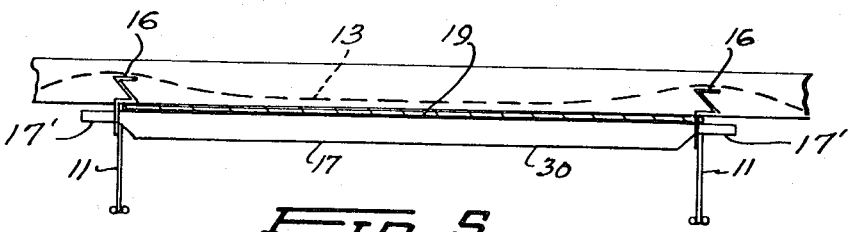
Figure 6:
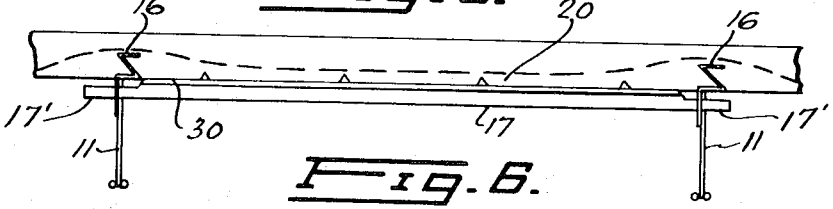

FIGS. 5 and 6 illustrate the use of spanner bars in accordance with the present invention to support formwork during the pouring of concrete. FIG. 5 closely resembles the left side of FIG. 1, and FIG. 6 closely resembles the right side of FIG. 1. As before, open web joists 11 support spanner bars 17 above which in FIG. 5 is mounted a plywood form 19 and in FIG. 6 a steel pan 20. It will be noticed in FIGS. 5 and 6 that the same spanner bar is used in both cases but that in FIG. 6 the offset edge 30 is positioned upwardly whereas in FIG. 5 the offset edge 30 is positioned facing down. This allows for the difference in thickness between the plywood form 19 and the steel pan 20. Thus in accordance with the invention a single type of spanner bar 17 may be used to support either plywood, for example, or steel pan formwork on which the concrete composite floor may be poured. It will also be noted that the top chords 16 of the novel open web joists 11 are substantially embedded in the concrete floor (though in practice the lower face 16*d*, and perhaps a short part of intermediate portion 16*c*, may or may not be embedded) and that the reinforcing mesh 13 hangs in a catenary shape upon and between the open web joists 11 providing the proper shear reinforcement for the concrete floor.

Figure 7:
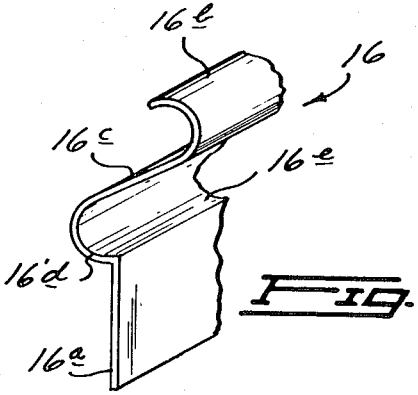
Figure 8:
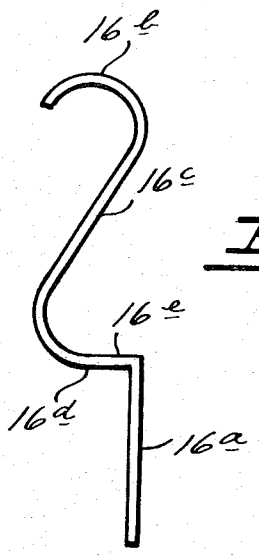

FIGS. 7 and 8 illustrate other alternative forms of serpentine shaped top chords. The Z-shaped top chord 16 of FIGS. 1–6 is altered in FIGS. 7 and 8 to a smoothly curved S-shaped surmounting the usual vertical flange 16*a* forming an integral top chord 16'. The opposite ends of the upper and lower curved flanges or portions 16'*b* and 16'*d* are integrally connected at opposite edges with the obliquely directed intermediate portion 16'*c*, and the whole chord is preferably cold rolled steel. In both embodiments, leg 16*a* depends from the free end 16'*e* of the bottom portion 16'*d*, which in FIG. 8 fully underlies the upper portion 16'*b* but only partially so if at all in FIG. 7.

Figure 9:
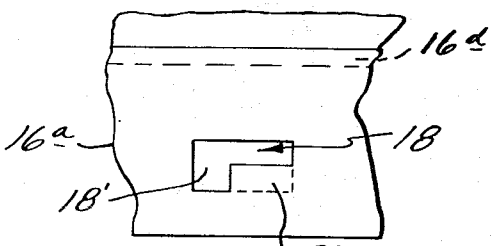

FIG. 9 illustrates an alternative form of opening 18 in the vertical leg or flange 16*a* of the open web joist for supporting the spanner bar. As before, opening 18 is provided with a knock out portion 21. In this case the L-shaped opening 18' is formed with a downwardly directed vertical leg 18' and a horizontally directed leg so that knock out portion 21 is a small rectangular member attached at two edges to the remaining metal of the vertical flange 16*a*.

As will become more apparent hereinafter, the vertical leg 18' of the openings 18 shown in FIGS. 2, 3 and 9 are not absolutely necessary, particularly when the thickness of the ends 17' is less than the height of opening 18. That is, with such a lesser thickness, the spanner bars 17 can be inserted into opening 18 while their breadth is in a horizontal position, and then the bars can be rotated or rolled into the vertical position shown for bars 17 in FIGS. 1–3.

As discussed below with regard to later figures, spanner bars 17 preferably have some sort of handle means to effect such rotation for insertion into and removal from openings 18.

From the foregoing, it is also apparent that knockouts 21 shown in FIGS. 2, 3, and 9 are not basically necessary either as long as the spanner bars 17 can be removed if desired from openings 18 without such knockouts.

As previously indicated, the top chords 16 in FIGS. 1–9 above are made of sheet metal, preferably cold rolled steel, all in one piece. Preferably also, spanner bars 17 are of heavier steel gauge than the sheet metal for top chords 16, for example, the thickness of spanner bars 17 may be in the order of ¼ inch to ½ inch metal plate while top chords 16 are of 10 to 17 gauge steel.

Spanner bars 17 are tightly fitted into openings 18 and, consequently, the heavier steel gauge of ends 17' may cause some deformation in the vertical legs 16*a* when the spanner bars are hammered, wedged and/or rolled into place in openings 18. This tight fit greatly improves the stability of the erected joists before concrete is poured. Generally spanner bars 17 are of rectangular cross-section with a maximum height, for example, in the order of two to three inches.

The spacing between adjacent joists which is usually approximately 4 feet, although of course, it may be any other desired distance. Normally the joist spacing is considerably greater than with prior steel joist/concrete slab construction since the slab in the present invention gives a composite action which increases the load bearing capacity beyond that of the joist above. It should be appreciated that the alone dimensions are given only as representative examples to which limitation is not intended.

As previously mentioned, the vertical legs 16*a* of top chords 16 depend from their respective lower portions 16*d* at the free or outer edges 16*e* thereof. As may be readily noted in FIGS. 1 and 2, as well as FIGS. 5 and 6, the top chords 16 are all oriented in the same way. For example, as seen in FIG. 1, all of the vertical legs 16*a* depend on the left side of their respective top chords 16. This is shown in greater detail in FIG. 2 from which it is also readily apparent that the intermediate flanges or portions 16*c* of the two top chords 16 extend obliquely in the same direction, i.e., both angle upwardly to the left. In other words, the Z configuration of each top chord is oriented in exactly the same manner as in the next top chord. This means that each spanner bar 17 which is disposed between successive top chords is overlaid by only one of the lower portions 16*d* of those chords. Consequently, in constructing the formword, the plywood panel 19 or steel panel 20 shown in FIGS. 1, 5 and 6 may have one of its longitudinal edges pushed on the spanner bars underneath the lower portion 16*d*, and then the opposite edge of that plywood or steel panel is dropped or otherwise brought down to rest on the spanner bars adjacent the opposite leg 16*a*. This provides for a relatively tight fit of the panel causing a substantially concrete leakproof pouring form, though in fact there may be a one-half inch or so leeway between the panel edges and the legs 16*a*. Additionally, this provides for ready removal of the panels from below after the concrete has set, by merely removing the spanner bars in the manner above described, allowing the panels to be recovered for reuse if desired. The plywood forms, which conveniently may be standard 4 foot by 8 foot sheets, provide a diaphragm action to further stiffen the floor before concrete is poured.

As is apparent from the foregoing, all joists normally have flush shoes and hence no infilling is required between joists in masonary constructions. This leads to a reduction in sound transmission. In addition, the stiffness of the resulting composite steel and concrete floor reduces both vibration and deflection.

Still further embodiments of the invention are discussed below.

Figure 10:
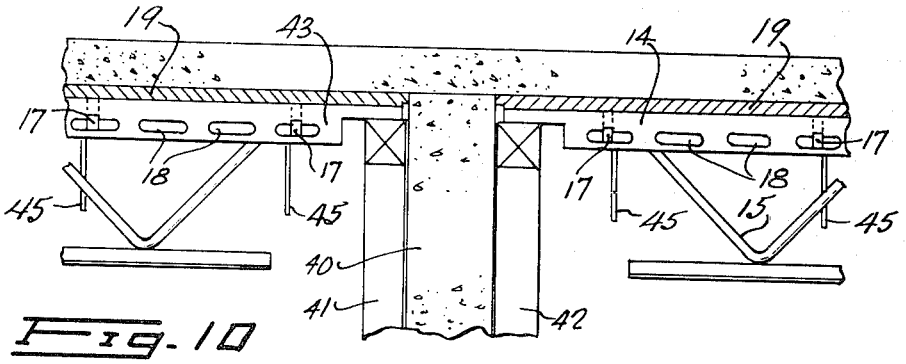

In FIG. 10 there is shown a vertical section through a building utilizing a construction system of the present invention. As illustrated, there is shown a concrete wall 40 which may be either poured, masonary, block or could alternatively be a column placed ahead of the floor system. On either side of the wall 40 are placed temporary scaffolds 41 and 42 on the top ends of which are supported open web steel joists or bar joists 43 and 44 which have open webs 15 as previously described.

Supported between successive open web joists are rigid panels 19, for example of plywood. These panels span transversely to the joists 43 and 44, the ends of the spanner bars being received in openings 18 formed in the lower edge of the top chord or in the upper part of the web of the open web joists 43 and 44.

The steps in the process of erecting a building utilizing the building system of FIG. 10 typically would consist of pouring a floor or foundation, erecting vertical walls or columns, positioning temporary scaffolding to support the open web joists, inserting spanner bars and plywood panels between the joists, and pouring the successive floor of the building. After an appropriate period of time, for example, seven days, the spanner bars and panels would be stripped from the open web joists, and after a further period of time, for example 28 days, the open web joists would be removed, together with the temporary scaffolding. This material could then be raised to a higher floor of the building and reused to make formwork for pouring a succeeding upper floor of the building. The poured concrete floor would be reinforced in the usual way to carry all loads between the vertical walls and columns.

It should be noted that there is no need for reshoring of the poured concrete floors in this system. By allowing the open web joists to remain in place, the necessity for reshoring is avoided, and thus the construction of the building can be accelerated since mechanical trades can have access to the floor at an earlier data than would be required if reshoring were utilized.

As an alternative form of construction it is within the scope of the present invention to support the open web joists as permanent portions of the building structure, and to incorporate the open web joists as permanent portions of the building. Such open web joists may either have a conventional top chord having a flat upper surface, or may utilize a form of top chord provided with shear connection to the concrete to give a composite action which results in a significant decrease in the cost of building construction as hereinbefore described. It will be appreciated that any poured concrete structure will of course have to include reinforcing elements to strengthen the concrete, but for the sake of simplicity such reinforcement has not been illustrated in FIG. 10.

With the system of the present invention it is possible to utilize standard material sized to form the plywood panels and the spacing of the open web joists may for example be advantageously fixed at approximately four foot centers, thereby enabling the use of standard 4 × 8 sheets of plywood which are the most inexpensive size commercially available. It should also be recognized that in accordance with contemporary construction practice, such plywood panels would be treated with a release coating, such as oil, to avoid adherence of the concrete to the panel. Such a release coating enables the ready stripping of the forms from beneath the poured concrete floor with a minimum loss of formwork due to accidental destruction.

As illustrated in FIG. 10, and in other sheets of the drawings, the spanner or roll bars 17 may be equipped with one or more permanent handles 45 or alternatively such roll bars may be utilized together with removable handles resembling spanner wrenches which are utilized to grasp the roll bar for rotation during insertion and removal. As further discussed hereinbelow, the roll bars are formed of a material of a substantially rectangular cross-section and are suitably notched at the ends to stabilize the positioning of the joists during construction. Additionally, the plywood panels utilized together with the roll bars serve to give a diaphragm action to reinforce the formwork against horizontal loads during pouring of the concrete floors.

Figure 11:
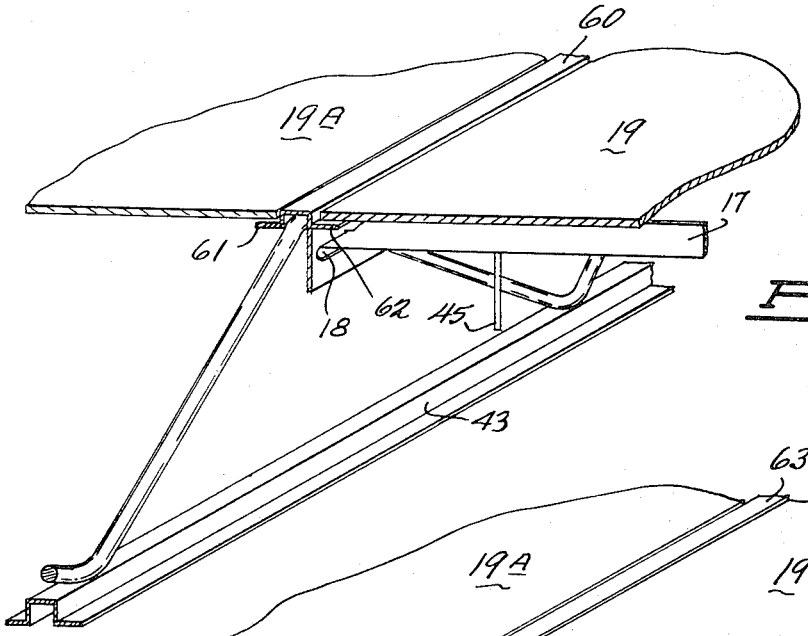
FIG. 11 is a perspective view partly broken away illustrating removable formwork pursuant to the present invention.

In FIG. 11 there is illustrated in perspective a section of formwork used in a building system pursuant to the present invention as illustrated in FIG. 10. The open web joist 43 supports a spanner bar or roll bar 17 on which a rigid plywood panel 19 is positioned. A like panel 19A is positioned on the opposite side of the open web joist 43 from the panel 19 and is supported by a spanner bar (not illustrated). The form of open web joists shown in FIG. 11 utilizes a "hat" section top chord which has a substantially flat upper surface 60 and horizontally extending flanges 61 and 62 to support the edges of the plywood forms 19A and 19 respectively. A portion of an elongated opening 18 is also illustrated in the drawing.

Figure 12:
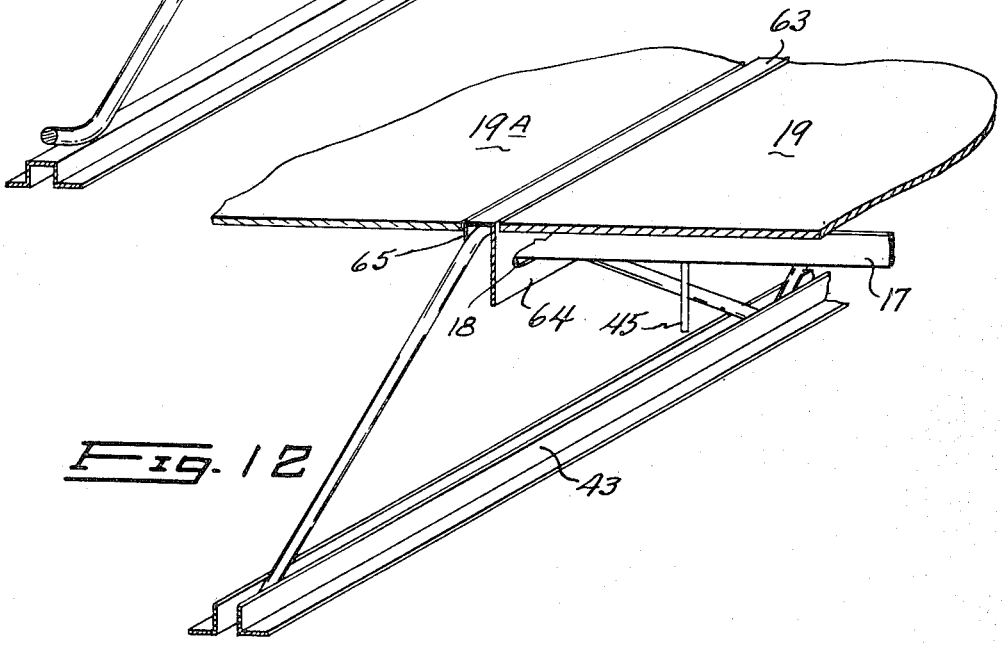
FIG. 12 is a perspective view similar to FIG. 11 illustrating a slightly modified type of top chord in removable formwork of the invention.

FIG. 12 illustrates an alternative form of top chord which is provided with a flat upper surface 63 with one long vertical leg 64 and a short vertical leg 65. As before, the long vertical leg is provided with elongated openings 18 for cooperation with the roll bars 17 which support panels 19, and 19A.

Figure 13:
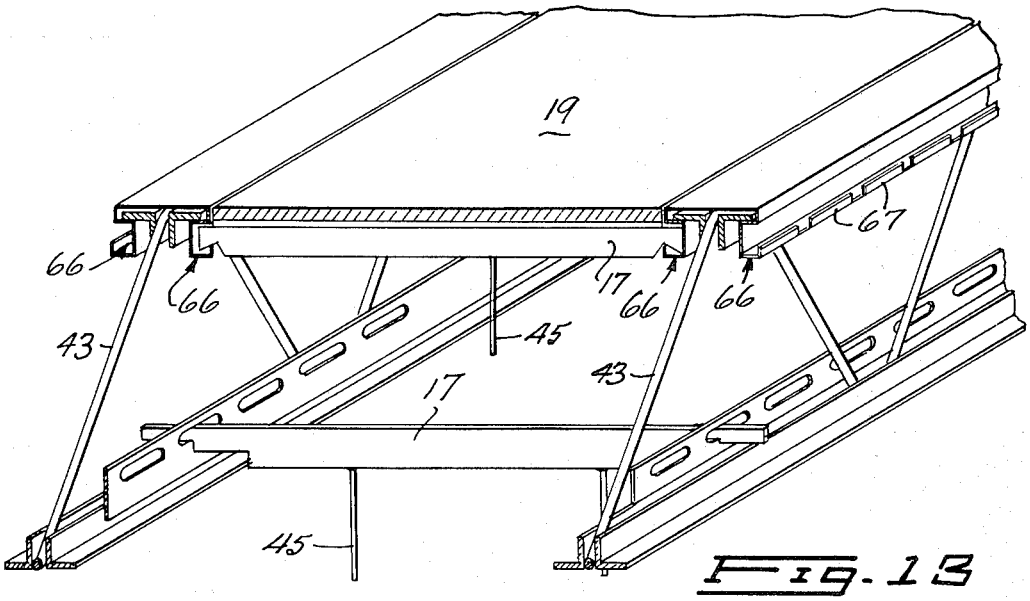
FIG. 13 is a perspective view of yet another form of the reusable formwork system pursuant to the present invention.

FIG. 13 illustrates an alternative embodiment of the invention utilizing an alternative form of top chord for each of the open web joists 43 and in which a second (lower) roll bar 17 is utilized to connect the bottom chords of the open web joists 43 to provide bridging where necessary for strengthening the formwork. As before, the plywood panel 19 is supported by the upper roll bar 17 and fits between, and have its upper surface substantially flush with, the tops of the top chords of joists 43. It will be noted that the form of top chord illustrated in FIG. 13 (also partially shown in FIG. 21) includes a channel 66 with upwardly extending lips 67 positioned at either side of the joist into which the method ends of the upper roll bars 17 are fitted. Between successive lips 67 in this channel, notches are provided at appropriate locations so that the roll bars may be removed after pouring of the concrete floor.

Figure 14:
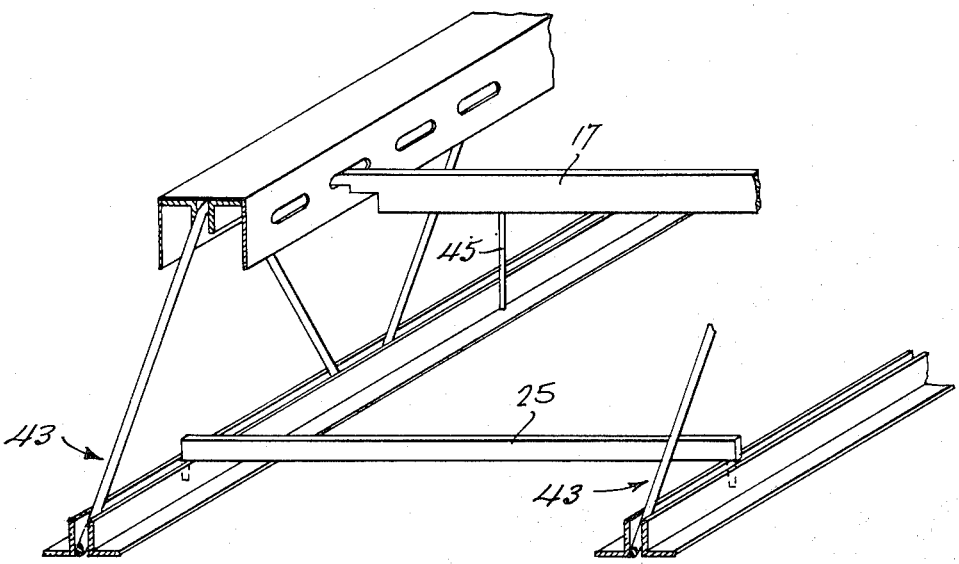
FIG. 14 is a perspective view with the panels removed of yet another form of reusable formwork of the invention.

FIG. 14 illustrates another alternative embodiment of the invention in which the top chord is formed in the shape of an inverted channel with elongated openings for cooperation with the ends of the roll bars 17, and a bridging bar 25 is provided connecting the bottom chord of the open web joist which bottom chord is formed by a pair of angles with a space therebetween.

FIGS. 15, 17 and 19 illustrates other configurations of elongated opening 18 formed in the side of the joist for supporting of any of the spanner bars shown in FIGS. 2, 3, 16, 18, 22 or 28. FIG. 17 illustrates the most preferred shape of opening 18 and is especially well adapted for use with the spanner bar of FIG. 28.

FIG. 16 illustrates a form of spanner or roll bar 17 formed of rectangular cross-section material with an inverted triangular shaped notch 26 in each end of the bar 17, while in FIGS. 18 and 22 notches 26 are rectangular and respectively in the upper and lower surfaces of the bars. Preferably the notches 26 in the spanner bars of FIGS. 18 and 22 have a width slightly greater than the gauge of the top chord material. In use bar 17 is turned with handles 55 so that the flat side of the material extends in the long direction of the hole 18, and the bar may then be inserted in the hole and rotated so that the sides of the notch 26 engage the bottom edges of the hole 18 to fix the bar in relation to the hole 18.

FIG. 20 illustrates another form of top chord which might be utilized with spanner bars of shape illustrated in FIG. 22. In this case the notches 26 are formed in the lower edge of the spanner bar and sit on the upturned lips 28 of the top chord of the open web joist.

FIG. 21 illustrates a shape of top chord also shown in FIG. 13 which has a channel 66 provided with upturned lips 67 to cooperate with a spanner bar such as that illustrated in FIG. 22.

FIG. 23 illustrates the application of the principles of the present invention to erect formwork for vertical constructions such as the pouring of concrete walls. FIG. 24 is a perspective from one side of the formwork illustrated in FIG. 23, and the two figures of drawings will be described together for simplicity. A vertically extending member 50 which resembles an open web joist of tapering depth is positioned vertically and provided with a channel 51 with a plurality of elongated openings 52. Spanner or roll bars 53 are inserted in the openings 52 in the channel 51 and serve to support rigid panels 54 from outward motion. A bottom tie consisting of a pipe spacer 56 is provided at the base of the wallform and a top tie 56 is positioned at the top of the wallform. As before the concrete wall is poured the shape being retained by the formwork and after the concrete has set the formwork is stripped by removal of the spanner bars and the panels and subsequently by removal of the vertical reinforcing members 50.

Figure 25:
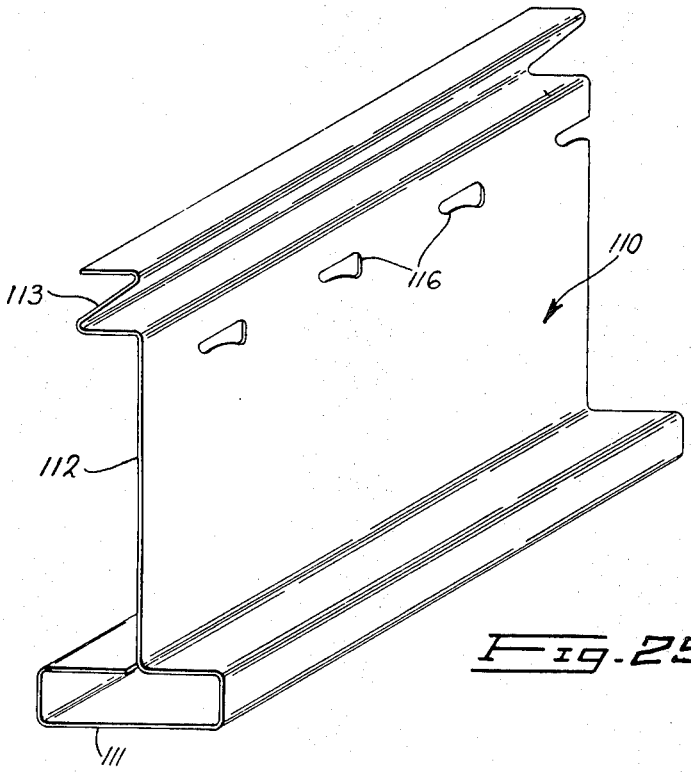
FIG. 25 is a perspective view of a cold rolled sheet steel joist in accordance with a preferred form of the invention.
Figure 26:
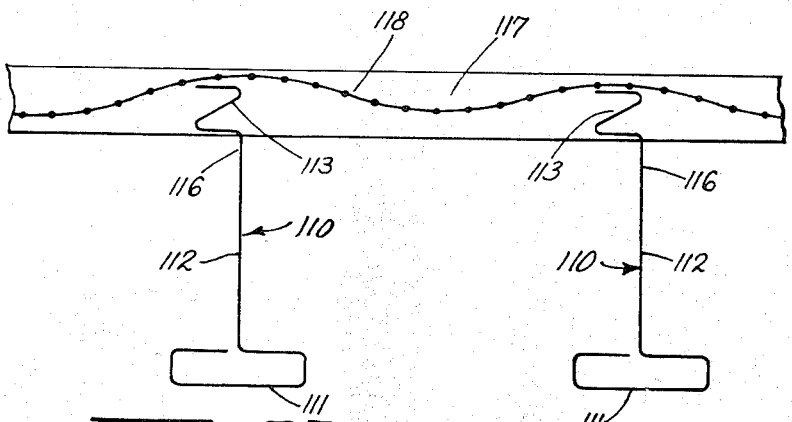
FIG. 26 is a vertical section through a composite floor system using the applicant's novel cold rolled steel joists.
Figure 27:
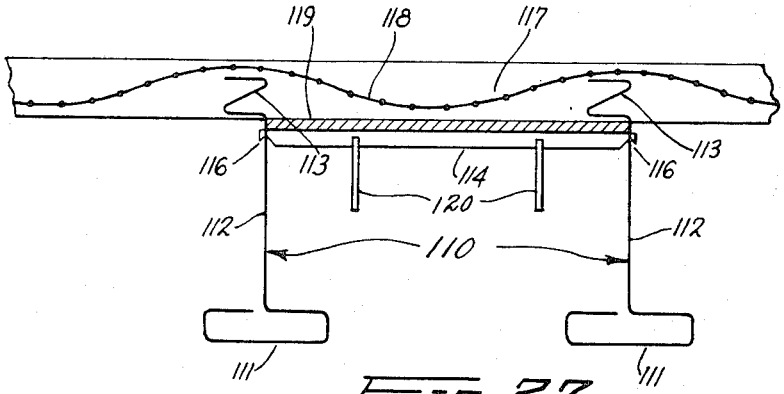
FIG. 27 is a vertical section illustrating the spanner bar and novel cold rolled sheet steel joist; and, FIG. 28 is a plan view of a spanner bar in accordance with a preferred embodiment of the invention.

In FIG. 25, there is shown in perspective a joist 110 constructed of a single piece of cold rolled sheet steel in accordance with the present invention. The joist is generally in I beam form and includes a bottom chord 111 which may, for example, have in a generally rectangular shape, a vertical flange 112 and a generally Z-shaped top chord 113. In erecting the composite floor system described in FIGS. 26 and 27, special cold rolled sheet steel joists 110, in a similarly oriented and properly spaced parallel relationship, are supported at opposite ends upon any usual and conventional supports.

Positioned between two such novel joists 110 are spanner bars 114 which may have tapered and notched ends 115 as shown in FIG. 16, or conform to the preferred shape FIG. 28. The ends 115 cooperate with the tapered openings 116 in the vertical leg or flange 112 and are wedged into openings 116 during erection. The plurality of openings 116 are generally rectangular in shape with one side so tapered from the bottom of the top that when spanner bar end 115 is inserted and hammered into the opening 116 spanner bar 114 becomes wedged securely. Preferably the roll bar or spanner bar 114 are provided with handles 120 to assist in positioning the roll bar during erection. Supported on the spanner bar 114 is the reusable formwork 119 which is effectively sealed against loss of wet concrete by the return lip or bottom portion of the Z-shape of the top chord 113 and the vertical face 112 of the opposite joist 110.

Once the spanner bars are removed the openings 116 may serve as pass-ways for electrical and mechanical conduits thereby permitting a saving in the height required between floors.

The top chords 113 of the novel joist 110 is embedded in the concrete floor 117 which is part of this composite floor system, and the reinforcing mesh 118 hangs in a catenary shape between the novel joists 110 to provide a proper reinforcement for the concrete slab. Thus the concrete slab becomes part of the top chord.

FIG. 28 is a dimensioned plan of a roll bar or spanner bar which is the most preferred form for commercial use. As shown, the roll bar 130 is formed of ½ inch thick steel plate and has an overall length of 4 ft. 5¾ inches. Slots 131 and 132 are spaced apart 4 ft. - 1 ¼ inches so that standard 4 foot sheets of plywood may be used for formwork. The slots 131 and 132 are approximately 5/8 inch deep and slightly wider than the gauge of sheet steel used in forming the top chord of the beams. One end 133 projects 4 inches beyond the left end slot 131 of the bar 130 and the other end 134 projects one-half inch beyond the slot 132. A pair of handles 135 and 136 are tack welded to the roll bar 130 to facilitate insertion and removal of the roll bar 130. The extended end 133 has proven to be very useful for supporting short sections of formwork where insufficient room is available for a full length roll bar. Other advantages in the use of this form of roll bar are readily apparent to those involved in the construction of buildings pursuant to the teachings of this application.

Further modifications will become apparent to those acquainted with this art and such are to be included in the scope of this invention as defined by the following claims.

We claim:

1. In the art of building concrete structures, the combination of at least two adjacent steel joists and at least one removable and reusable spanner bar for use in constructing steel and concrete structures by spacing said adjacent steel joists apart a predetermined distance to support concrete pouring forms between those joists at a location to provide lateral and torsional stability, each said joist having at least one opening, substantially aligned with a like opening in the next joist with the joist steel adjacent each said opening therein being of given gauge and the openings being of at least a predetermined length and given height for receiving respective ends of said spanner bar, the improvement in said spanner bar comprising:

an elongated unitary non-adjustable steel bar having throughout its length a rectangular transverse cross-section with top and bottom surfaces and sides, said top and bottom surfaces being narrower than the sides thereof to form said rectangular cross-section, said bar further having a central section and having two opposite ends which extend inwardly to said central section with their top surfaces flush therewith, said ends having a height between said top and bottom surfaces that is substantially less than the height of said central section, said central section being the same width as said ends and being a multiplicity of times longer than at least one of said ends, the width from side to side of said opposite ends and the said height thereof being such that the opposite ends can be readily inserted into and removed from said openings only when one of said sides is facing upward, the said height from top to bottom surfaces of said ends being greater than said given height of said joist opening but less the said predetermined length of said joist opening, hand means fixedly secured to and depending from said central section for installing and rotating said bar into a said pair of oppositely aligned openings, securing and distance gauging means in the top one of said surfaces of said bar and only in its said surfaces of said bar and only in its said opposite ends, said securing and distance gauging means consisting of one and only one notch in each of said opposite ends with said notches being rectangular and disposed outwardly from said central section a substantial given distance with at least one of said notches being disposed from the outer end of its respective opposite end a distance substantially less than the said given distance for aiding insertion and removal of said bar into and from said aligned joists openings by reciprocal longitudinal movements and with the said notches being separated a predetermined gauging distance and each notch having a width substantially the same as said given gauge, for aligning and tightly interlocking said bars and joists and securingly spacing adjacent joists substantially parallel for their full length at said predetermined distance apart when each spanner bar is inserted in its respective pair of openings with a said side facing upwardly and then rotated by said handle means until said top surface faces upwardly to cause said notches to interlock with the steel joists as aforesaid with said top surface disposed vertically at said location to cause said pouring forms to provide said lateral and torsional stability.

2. The combination in claim 1 wherein the said opposite end having the other notch extends outwardly from its said notch a distance substantially greater than said given distance.

3. The combination in claim 1 wherein each said joist has extending in its longitudinal direction a shaped part substantially in the form of an S or Z in transverse cross-section and metal means vertically depending substantially from the lower free end of said shaped part and containing said opening adjacent said lower free end, said joists being disposed with their shaped parts oriented in the same way.

4. In the art of building concrete structures, the combination of at least two adjacent steel joists and at least one removable and reusable spanner bar for use in constructing steel and concrete structures by spacing said adjacent steel joists apart a predetermined distance to support concrete pouring forms between those joists at a location to provide lateral and torsional stability, each said joist having at least one opening substantially aligned with a like opening in the next joist with the joist steel adjacent each said opening therein being of given gauge and each said opening being of at least a predetermined length and given height for receiving respective ends of said spanner bar, the improvement in said spanner bar comprising:

an elongated unitary non-adjustable steel bar having a central section and two opposite ends, said ends having rectangular transverse cross-sections and extendingly inwardly to said central section, said ends having top and bottom surfaces and sides with the said top and bottom surfaces of the opposite ends being narrower than the sides thereof to form said retangular cross-sections, the said top surfaces of said ends being flush with the top surface of said central section to support said pouring forms, said central section having a substantially greater height than said opposite ends and being a multiplicity of times longer than at least one of said ends, the width from side to side of said opposite ends and the height thereof being such that the opposite ends can be readily inserted into and removed from said openings only when one of said sides is facing upwardly, the height from said top to bottom surfaces of said ends being greater than said given height of said joist opening but less than said predetermined length of said joist opening, and securing and distance gauging means in one of said surfaces of said bar and only in its said opposite ends, said securing and distance gauging means consisting of only one notch in each of said opposite ends with the said notches being rectangular and separated a predetermined gauging distance and each notch having a width substantially the same as said joist steel given gauge, for aligning and tightly interlocking said bars and joists and securingly spacing adjacent joists substantially parallel for their full length at said predetermined distance apart when each spanner bar is inserted in its respective pair of openings with a said side facing upwardly and then rotated until said top surface faces upwardly to cause said notches to interlock with the steel joists as aforesaid with said top surface disposed vertically at said location to cause said pouring forms to provide said lateral and torsional stability.

5. The combination in claim 4 wherein each said rectangular notch is in said top surface.

6. The combination in claim 4 wherein each said notch is in said bottom surface.

7. The combination in claim 4 wherein each said joist has extending in its longitudinal direction a shaped part with a transverse cross-section substantially in the form of an S or Z and metal means vertically depending substantially from the lower free end of said shaped part and containing said opening adjacent said lower free end, said joists being disposed with their shaped parts oriented in the same way.

8. The combination in claim 4 wherein each of its said opposite ends has a width the same as said central section.

9. A reusable spanner bar as in claim 4 including handle means secured to and depending from a point no higher than the top surface of said steel bar for aiding in the rotational securement of the said spanner bar ends to and from said joist openings.

10. The combination in claim 4 wherein said opposite ends extend inwardly from their respective notches with said given rectangular cross-section for only a given distance, and wherein at least one of said notches is disposed from the outer end of its respective opposite end a distance substantially less than the said given distance for the other said notch for aiding insertion and removal of said bar into and from said joists.

11. The combination in claim 10 wherein the said opposite end having said other notch extends outwardly from its said notch a distance substantially greater than said given distance.

* * * * *